US010420993B2

(12) United States Patent
Pergande et al.

(10) Patent No.: US 10,420,993 B2
(45) Date of Patent: Sep. 24, 2019

(54) IRON-TYPE GOLF CLUB HEAD WITH BODY WALL APERTURES

(71) Applicant: Wilson Sporting Goods Co., Chicago, IL (US)

(72) Inventors: Jon C. Pergande, Chicago, IL (US); Mark A. Spencer, Chicago, IL (US); Mark A. Kerscher, Chicago, IL (US); Michael D. Vrska, Jr., Mundelein, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 15/668,558

(22) Filed: Aug. 3, 2017

(65) Prior Publication Data

US 2017/0326416 A1 Nov. 16, 2017

Related U.S. Application Data

(63) Continuation-in-part of application No. 15/606,981, filed on May 26, 2017, which is a continuation of application No. 14/816,796, filed on Aug. 3, 2015, now Pat. No. 9,662,549.

(51) Int. Cl.

| | |
|---|---|
| ***A63B 53/04*** | (2015.01) |
| ***A63B 60/52*** | (2015.01) |
| ***A63B 60/54*** | (2015.01) |
| ***A63B 53/06*** | (2015.01) |

(52) U.S. Cl.

CPC ..... *A63B 53/047* (2013.01); *A63B 53/0475* (2013.01); *A63B 53/06* (2013.01); *A63B 60/52* (2015.10); *A63B 60/54* (2015.10); *A63B 2053/0408* (2013.01); *A63B 2053/0416* (2013.01); *A63B 2053/0495* (2013.01); *A63B 2209/14* (2013.01)

(58) Field of Classification Search

CPC ..... A63B 53/0475; A63B 2053/0416; A63B 53/06; A63B 2053/0495; A63B 60/54; A63B 53/0466

See application file for complete search history.

(56) References Cited

U.S. PATENT DOCUMENTS

| | | | |
|---|---|---|---|
| 1,154,490 | A | 9/1915 | Davis |
| 3,810,631 | A | 5/1974 | Braly |
| 3,989,248 | A | 11/1976 | Campau |
| 4,398,965 | A | 8/1983 | Campau |

(Continued)

FOREIGN PATENT DOCUMENTS

| | | |
|---|---|---|
| JP | 2901876 | 6/1999 |

*Primary Examiner* — Michael D Dennis

(74) *Attorney, Agent, or Firm* — Terence P. O'Brien; Todd A. Rathe

(57) ABSTRACT

An iron-type golf club head includes a body having a wall extending about an opening, a faceplate coupled to the body across the opening, a first set of apertures, and at least one second aperture. The wall has an outer peripheral surface, a sole, a toe and a topline. The wall and the faceplate define a rearward-facing cavity. The first set of apertures extends through the wall from the peripheral outer surface to the cavity. The first set of apertures extends about a first plane. The at least one second aperture extends through the wall from the peripheral outer surface to the cavity. The at least one second aperture extends about a second plane.

23 Claims, 13 Drawing Sheets

(56) References Cited

U.S. PATENT DOCUMENTS 5,282,625 A 2/1994 Schmidt et al.
5,330,187 A 6/1994 Schmidt et al.
5,358,249 A 10/1994 Mendralla
5,472,203 A 12/1995 Schmidt et al.
5,492,327 A 2/1996 Biafore, Jr.
5,499,814 A 3/1996 Lu
5,603,668 A 2/1997 Antonious
5,643,106 A 7/1997 Baird
5,749,795 A 5/1998 Schmidt et al.
6,001,030 A 12/1999 Delaney
6,042,486 A 3/2000 Gallagher
6,080,069 A 6/2000 Long
6,592,468 B2 7/2003 Vincent et al.
6,616,547 B2 9/2003 Vincent et al.
6,709,345 B2 3/2004 Iwata et al.
6,811,496 B2 11/2004 Wahl et al.
6,921,343 B2 7/2005 Solheim
6,932,717 B2 * 8/2005 Hou ..... A63B 53/047 473/332
7,083,530 B2 8/2006 Wahl et al.
7,131,913 B2 11/2006 Iwata et al.
7,160,204 B2 1/2007 Huang
7,303,486 B2 12/2007 Imamoto
7,393,286 B1 7/2008 Renegar
7,744,486 B2 6/2010 Hou et al.
7,806,779 B2 10/2010 Franklin et al.
7,867,105 B2 1/2011 Moon
8,092,318 B2 1/2012 Oldknow et al.
8,105,181 B2 1/2012 Blumenkrantz et al.
D659,780 S 5/2012 Llewellyn et al.
8,210,965 B2 7/2012 Roach et al.
8,277,337 B2 10/2012 Shimazaki
8,282,506 B1 * 10/2012 Holt ..... A63B 53/047 473/328
8,409,022 B2 4/2013 Oldknow et al.
8,425,342 B2 4/2013 Snyder et al.
8,435,134 B2 5/2013 Tang et al.
8,485,918 B2 7/2013 Roach et al.
8,491,416 B1 7/2013 Demille et al.
8,556,746 B1 10/2013 DeMille et al.
8,562,459 B1 10/2013 DeMille et al.
D696,367 S 12/2013 Taylor et al.
8,602,910 B2 12/2013 Swartz
8,632,419 B2 1/2014 Tang et al.
8,708,837 B2 4/2014 Roach et al.
8,758,163 B2 6/2014 Sites
8,821,313 B1 9/2014 Dawson et al.
8,911,301 B1 12/2014 Allen
8,911,302 B1 12/2014 Ivanova et al.
8,961,336 B1 2/2015 Parsons et al.
9,044,653 B2 6/2015 Wahl et al.
9,079,081 B2 7/2015 Shimazaki
9,227,114 B2 1/2016 Takechi
9,421,435 B2 8/2016 Jertson et al.
9,480,888 B1 11/2016 Allen
9,492,722 B2 11/2016 Taylor et al.
9,623,299 B2 4/2017 Wahl et al.
9,662,549 B2 5/2017 Vrska, Jr. et al.
2007/0026961 A1 2/2007 Hou
2007/0243949 A1 10/2007 Solari
2009/0023513 A1 1/2009 Shibata et al.
2011/0130213 A1 6/2011 Chiu
2012/0196702 A1 8/2012 Shimazaki
2012/0196703 A1 * 8/2012 Sander ..... A63B 53/047 473/349
2013/0150179 A1 6/2013 Golden et al.
2013/0331201 A1 * 12/2013 Wahl ..... A63B 53/0475 473/329
2014/0274442 A1 9/2014 Honea et al.
2015/0057096 A1 2/2015 Nicolette et al.
2015/0133232 A1 5/2015 Taylor et al.
2016/0038796 A1 2/2016 Taylor et al.
2016/0045794 A1 2/2016 Taylor
2016/0339309 A1 11/2016 Taylor et al.
2017/0036076 A1 2/2017 Doi et al.
2017/0173411 A1 6/2017 Wahl et al.

* cited by examiner

IRON-TYPE GOLF CLUB HEAD WITH BODY WALL APERTURES

RELATED U.S. APPLICATION DATA

The present application is a continuation-in-part of U.S. patent application Ser. No. 15/606,981 filed on May 26, 2017, which is a continuation of U.S. patent application Ser. No. 14/816,796 filed on Aug. 3, 2015, now U.S. Pat. No. 9,662,549.

BACKGROUND

The game of golf typically utilizes woods, irons and a putter. Irons typically have shorter shafts and smaller club heads as compared to woods. The head of an iron is often made of solid iron or steel. The golf club head of an iron includes a large flat angled face, typically scored with grooves. Golf club irons vary in head size, shaft length and lie or loft angle.

DETAILED DESCRIPTION OF EXAMPLES

Figure 1:
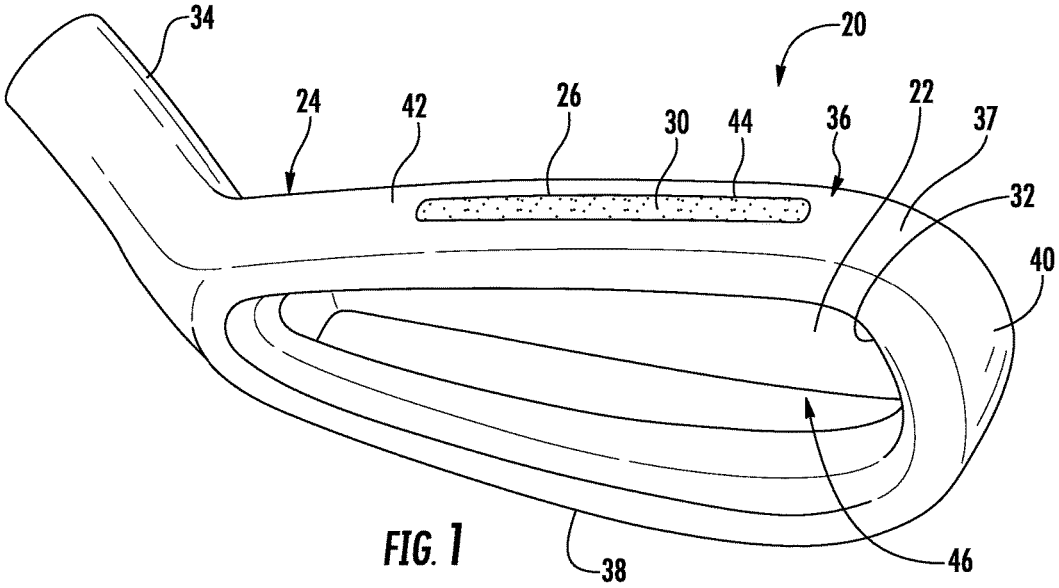
FIG. 1 is a rear perspective view of an example iron-type golf club head having an example aperture and plug.
Figure 6A:
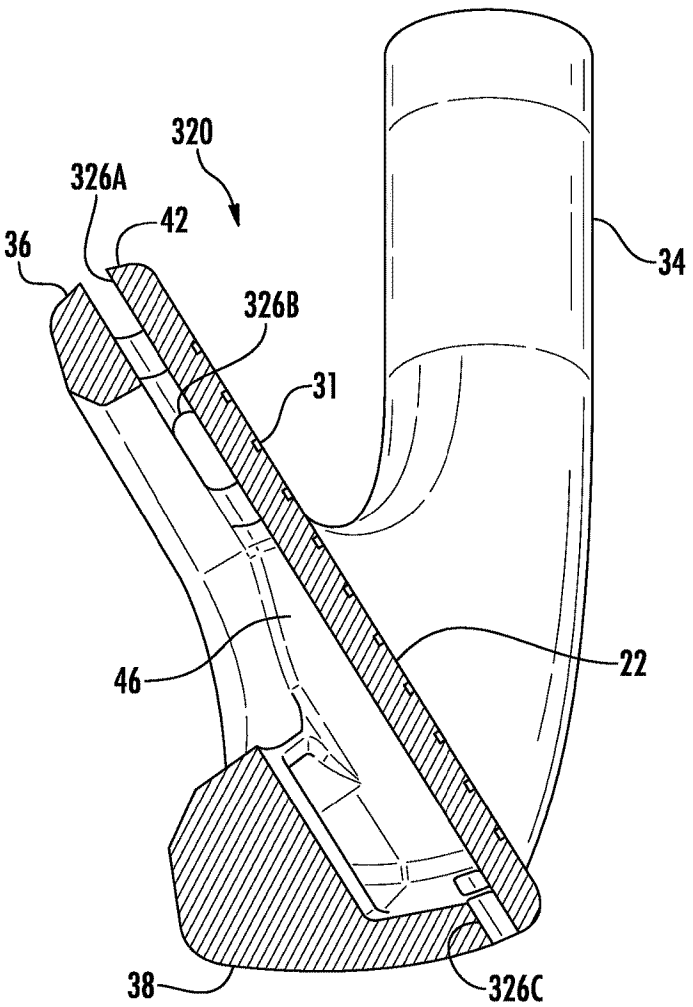
FIGS. 6A-6D are sectional views of an example iron-type golf club head, illustrating one example method for plugging or filling apertures in the golf club head.

FIG. 1 illustrates an example iron-type golf club head 20. Head 20 is for use with a golf club shaft. Head 20 comprises faceplate 22, body 24, aperture 26 and plug 30. Faceplate 22 comprises a plate that is coupled to body 24 across a front opening 32 defined by body 24. In one implementation, faceplate 22 is formed from a metal, such as steel. In one implementation, faceplate 22 includes a front surface having a series of grooves, scorelines or ridges 31 (shown in FIG. 6A). The faceplate 22 is configured for impacting a golf ball. In one implementation, faceplate 22 is welded or otherwise fixedly secured to body 24. In yet another implementation, faceplate 22 is cast as part of body 24. In still other implementations, faceplate 22 is removably mounted to body 24.

Body 24 supports faceplate 22 and interconnects faceplate 22 to a shaft of a golf club. Body 24 comprises hosel 34 and faceplate supporting wall 36. Hosel 34 comprises that portion of body 24 that connects to a shaft. In one implementation, hosel 34 comprises a hollow cylinder which receives an end portion of a golf club shaft. In another implementation, the hosel 34 may be inserted within the tip end of the golf shaft.

Faceplate supporting wall 36 extends from hosel 34. In one implementation, faceplate supporting wall 36 is integral with hosel 34, comprising a single unitary integral or homogenous structure. In one implementation, faceplate supporting wall 36 extends in a loop starting and ending at hosel 34. The loop forms an opening across which faceplate 22 spans. In one implementation, faceplate supporting wall 36 is formed from a single homogenous metal material, such as steel, wherein wall 36 has a relatively high degree of hardness. In other implementations, the faceplate 22 can be formed of titanium, a high strength steel, a fiber composite material, graphene or combinations thereof. In one implementation, the faceplate 22 and the wall 36 are formed of materials having a hardness of at least 15 on a Shore C hardness scale. For purposes of this disclosure, the term "metal" encompasses a single metal, multiple metals or alloys thereof. In other implementations, the body 24 can be formed of a fiber composite material, a polygonal material, iron, one or more metals, and combinations thereof.

As shown by FIG. 1, faceplate supporting wall 36 includes an outer peripheral surface 37, and comprises a sole 38, a toe 40 and a topline 42. Sole 38 comprises the underside of wall 36 which faces the ground when a ball is being addressed by head 20. Toe 40 comprises the end portion of head 20, generally opposite to hosel 34. Topline 42 comprises a top portion of wall 36 opposite to sole 38. As shown by FIG. 1, wall 36 extends rearward of faceplate 22 and cooperative with faceplate 22 to form an interior rearwardly facing cavity 46 that is founded in the front by faceplate 22 and along its sides by the interior sides of wall 36. Although wall 36 is illustrated as having a particular irregular oval shape, in other implementations, wall 36 may have other shapes or may form other looped shapes.

Aperture 26 comprises a passage or opening extending through wall 36, at at least one location rearward of faceplate 22. In one implementation, aperture 26 comprises an opening that extends completely through wall 36. In another implementation, aperture 26 comprises a crater, dimple or depression partially extending into wall 36, but does not extend completely through wall 36. In one implementation, aperture 26 comprises a through-wall aperture 26 extending into and through wall 36 to an inner surface of wall 36, adjacent cavity 46. In another implementation, aperture 26 comprises at least one depression, or aperture 26 extending partially into wall 36 from an outer perimeter surface of wall 36.

In the example illustrated, aperture 26 comprises an elongate slot, extending completely through wall 36, parallel to the edge of the corresponding adjacent portion of wall 36. In one implementation, aperture 26 comprises an elongate slot extending parallel to faceplate 22 or to an upper edge of faceplate 22. Although aperture 26 is illustrated as a single elongate slot extending across the majority of a length (the distance from hosel 34 to toe 40) of topline 42; in other implementations, aperture 26 may alternatively extend along other portions of sole 38 or toe 40.

Plug 30 comprises a structure or member that plugs, fills or includes aperture 26. Plug 30 has a hardness less than the hardness of wall 36. In one implementation, plug 30 has a hardness within the range of 15 on a Shore A hardness scale to a 95 on a Shore C hardness scale. In another implementation, the plug 30 has a hardness within the range of 70 to 95 on a Shore A hardness scale. Plug 30 has a degree of resiliency or flexibility greater than that of the material forming wall 36. As a result, during impact of a golf ball by faceplate 22, portions of wall 36 deflect against the material of plug 30, wherein plug 30 absorbs impact and resiliently deflects to provide a golfer with a unique feel. Additionally, the golf iron club head of the present invention, including club heads 20, 120, 220, 320 and 420, provide a unique, aesthetically-pleasing sound upon impact with a golf ball.

In one implementation, plug 30 completely occludes or blocks the passage from the exterior of wall 36 to the interior of wall 36 adjacent cavity 46. In such an implementation, plug 30 may be recessed from an outer mouth of aperture 26 or from an inner mouth of aperture 26 adjacent cavity 46. In one implementation, plug 30 occupies at least 80% of the cavity or volume of aperture 26. In other implementations, plug 30 completely fills aperture 26, extends at or beyond the outer mouth 44 of aperture 26 and/or extends at or beyond the inner mouth of aperture 26 adjacent cavity 46. In one implementation, plug 30 has an outer surface flush with the outer mouth 44 of aperture 26. In one implementation, plug 30 has an inner surface flush with the inner mouth of aperture 26 adjacent cavity 46.

In one implementation, plug 30 is formed from a polymer having a hardness less than that of the hardness of the material forming wall 36. In one implementation, plug 30 is formed from a polymer such as a urethane. In one implementation, plug 30 is formed from a rubber or rubber-like material. In yet another implementation, plug 30 is formed from a foam or foam material, such as a closed cell or open cell material, such as a closed cell or open cell polymeric material. In one implementation, plug 30 is deposited into aperture 26 while in a liquid state then allowed to cure and/or solidify within aperture 26. In another implementation, plug 30 is inserted into aperture 26 while in a solid-state or semi-solid state. In one implementation, plug 30 comprises a body that is inserted into aperture 26, wherein the body of plug 30 includes a gel or liquid. In other implementations, plug 30 is snapped into aperture 26, press fit into aperture 26, fused within aperture 26 or adhesively bonded to wall 36 within aperture 26 or combinations thereof.

FIGS. 2A-2D illustrate iron-type golf club head 120, another example implementation of head 20. Head 120 is similar to head 20 except that head 120 is specifically illustrated as comprising body 124 associated with apertures 126A-1261 (collectively referred to as apertures 126) and corresponding plugs 130A-1301 (collectively referred to as plugs 130). Apertures 126 are spaced about faceplate 22, through each of the sole 38, toe 40 and topline 42 of wall 36. In one implementation, apertures 126 each completely extend through wall 36. In one implementation, apertures 126 are each of similar length and width. In yet another implementation, apertures 126 and different lengths and/or widths and/or shapes. In the example illustrated in FIG. 2A, each of apertures 126 comprises a slot having a length L of at least about 0.125 inches and a width W of between 0.025 inches and 0.25 inches. In one implementation, each aperture 126 has a depth D equal to the thickness of the wall 136 through which the aperture 126 extends. In other implementations, each aperture 126 has a depth or thickness within the range of 0.045 to 0.150 inch. In one implementation, the length of the slots can vary about the wall 36 of the body 124. In one particular implementation, the slots 126A-C along the topline 42 of the wall 36 can have a length of within the range of 0.6 to 0.8 inch, the slots 126D-F about the toe 40 can have a length within the range of 0.6 to 0.8 inch, and the slots 126 G-I along the sole 38 can have a length within the range of 0.5 to 0.8 inch. In other implementations, other lengths and variations of lengths can be used. In another implementation, the width W of the slots 126 can be approximately 0.075 inch, and the through-wall depth of the slots 126 can be within the range of 0.125 to 0.130 inch. In other implementations, other widths and/or depths can be used.

Figure 2A:
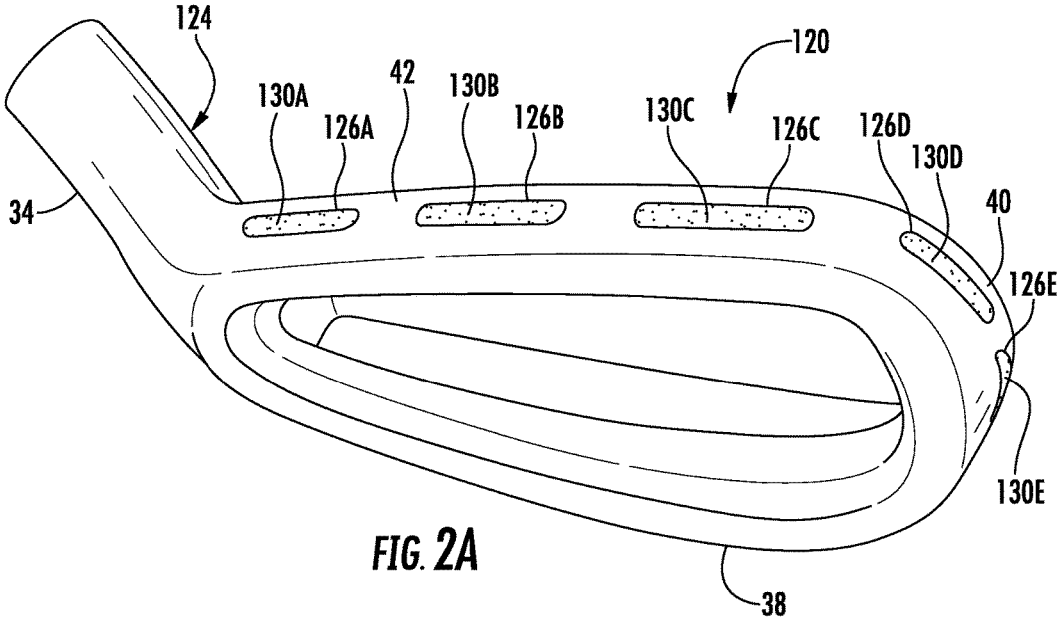
FIG. 2A is a rear perspective view of another example iron-type golf club head having another example arrangement of apertures and plugs.
Figure 2B:
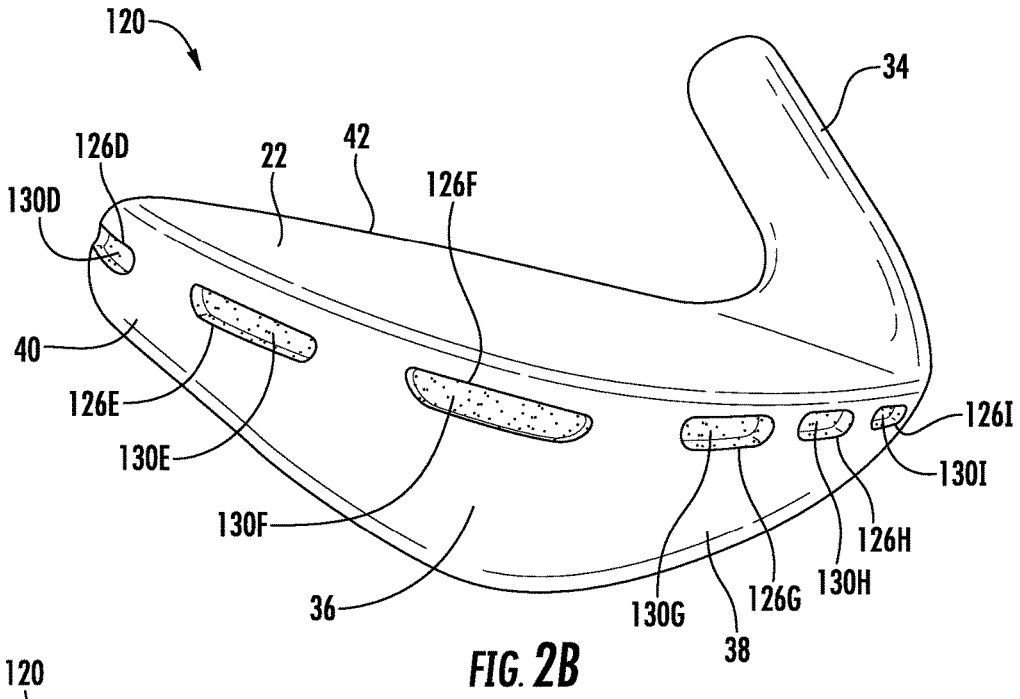
FIG. 2B is a bottom front perspective view of the golf club head of FIG. 2A.
Figure 2C:
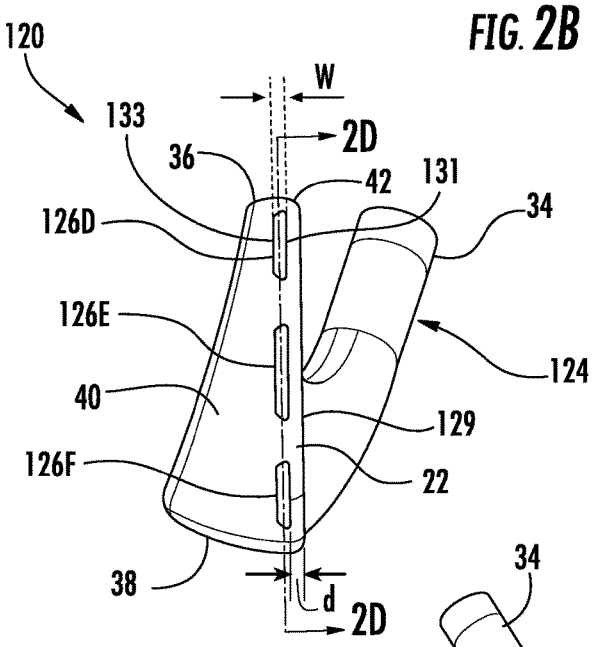
FIG. 2C is a toe end view of the golf club head of FIG. 2A.
Figure 2D:
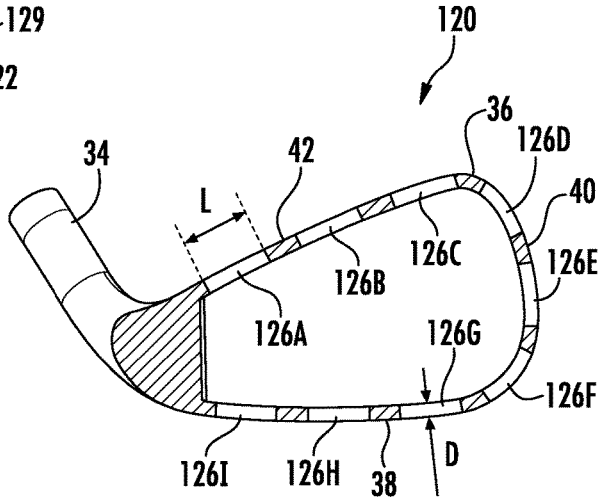
FIG. 2D is a sectional view of the golf club head of FIG. 2C take along line 2D-2D.

Referring to FIG. 2C, the faceplate 22 defines a generally planar impact surface 29. The slots 126 define forward and rearward edges 131 and 133 where the forward edge 131 is closer to the planar impact surface 129 of the faceplate 22 than the rearward edge 133. The forward edge of the slot 126 is preferably spaced apart from the planar impact surface of the faceplate 22 by a distance d within the range of 0.030 to 0.15 inch. In other implementations, the distance d can be other dimensions or vary from one slot to another slot. In one implementation, the distance d is substantially the same as the thickness of the faceplate 22.

Plugs 130 are each similar to plug 30 described above. Plugs 130 occupy their respective apertures 126 about cavity 46 and about faceplate 22. In the example illustrated, each of plugs 130 comprises a same material having the same hardness less than that of wall 36 and compressibility or flexibility that is greater than that of wall 36. In one implementation, each of plugs 30 equally fill their respective apertures 126. In another implementation, some of plugs 30 may have different sizes or different volumes. In some implementations, some of plugs 30 may occupy different percentages of the interior volume of their respective apertures 126. For example, in one implementation, apertures 126 along a first portion of wall 36 are filled to a first extent (the plug completely occluding the aperture having a first thickness, wherein such thicknesses is measured in a direction from the outer surface of wall 36 to the inner surface of wall 36 adjacent cavity 46) while apertures along a second portion of wall 36 are filled to a second different extent (the plug completely occluding such apertures but having a second different thickness). For example, in one implementation, aperture 126B may be completely filled by its respective plug while aperture 130E is only partially filled (a lesser thickness) by its respective plug. By varying the degree to which the respective apertures 126 are filled with or occupied by their associated plugs 130, the characteristics of head 120 may be varied or customized as desired according to the particular golfer's preferences.

Figure 3:
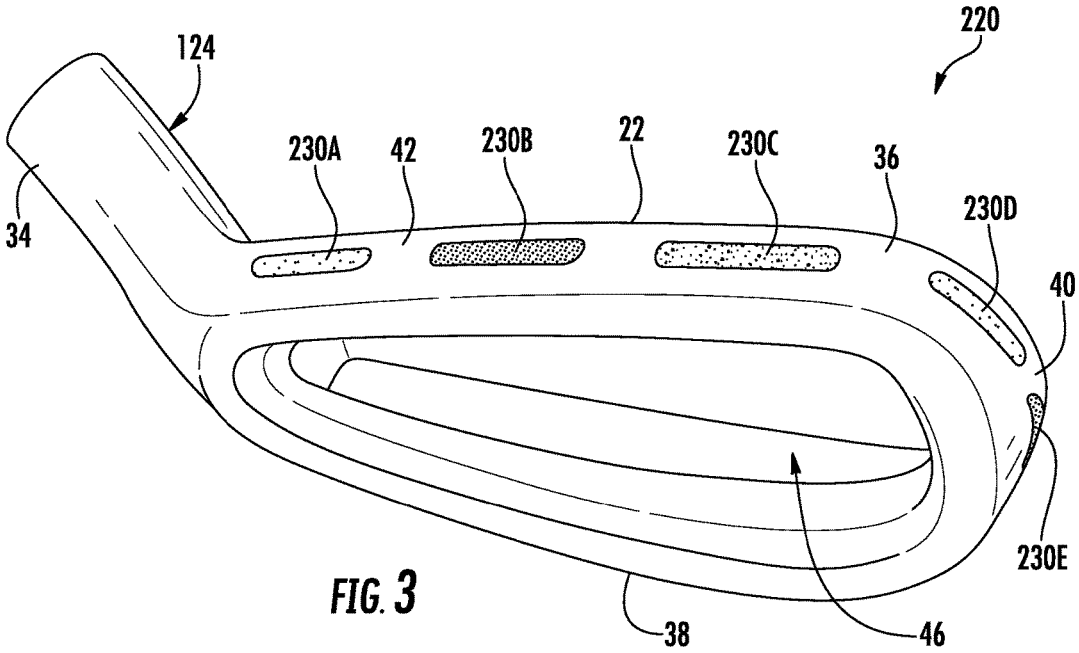
FIG. 3 is a rear perspective view of another example iron-type golf club head having another example arrangement of apertures and plugs.

FIG. 3 illustrates iron-type golf club head 220, another implementation of head 20. Head 220 is similar to head 120 described above except that head 220 is specifically illustrated as having plugs 230A-230I (collectively referred to as plugs to 30) in lieu of plugs 130A-1301, respectively. Plugs 230 are similar to plugs 130 except that plugs 230, amongst themselves, are formed from different materials or materials having different properties or characteristics. In the example illustrated, plugs 230A, 230B and 230C are formed from different materials (as indicated by the different representative stippling) having different hardness properties and/or different resiliency/compressibility properties. For example, in one implementation, plug 230A may comprise a first type of urethane and plugs 230B and 230C are formed from different types of urethanes. In one implementation, plug 230A is formed from a solid polymer while plug 230B and/or 230C is formed from an open or closed cell polymer. The different material properties of plugs 230 allow the absorption or impact characteristics of head 222 be selectively varied with respect to different adjacent portions of faceplate 22. In one implementation, the plugs 230 along the topline can be formed of a first material having a first hardness, the plugs along the toe can be formed of a second material having a second hardness, and the plugs along the sole can be formed of a third material having a third hardness. The first, second and third hardness can be the same, or differ from each other such that one region of the body 124 provides a slightly different response or feel as other regions. In some implementations, different clubs may be provided with different combinations of plugs or patterns to customize the performance of head 222 an individual golfer's skill level or personal preferences.

Figure 4A:
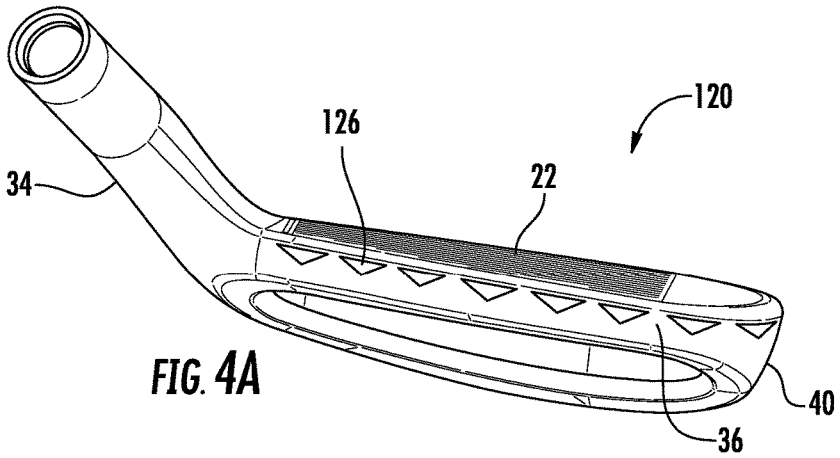
FIGS. 4A-4D are upper perspective views of other examples of iron-type golf club heads having other example arrangements of apertures and plugs.
Figure 4B:
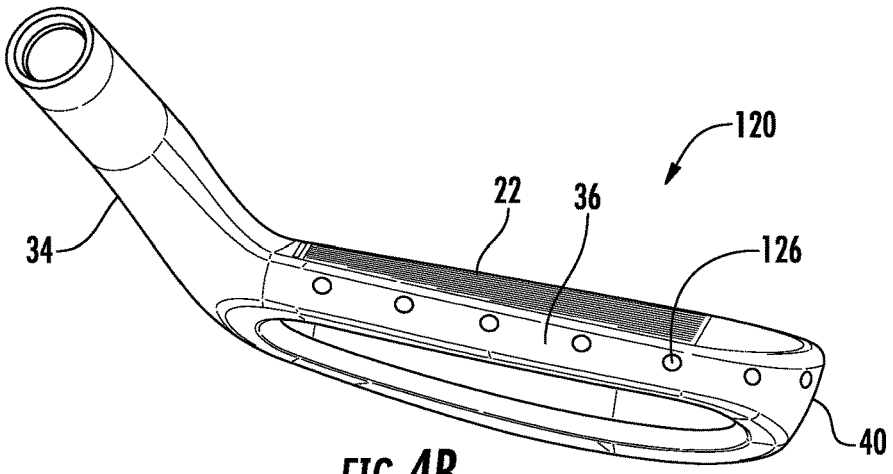
Figure 4C:
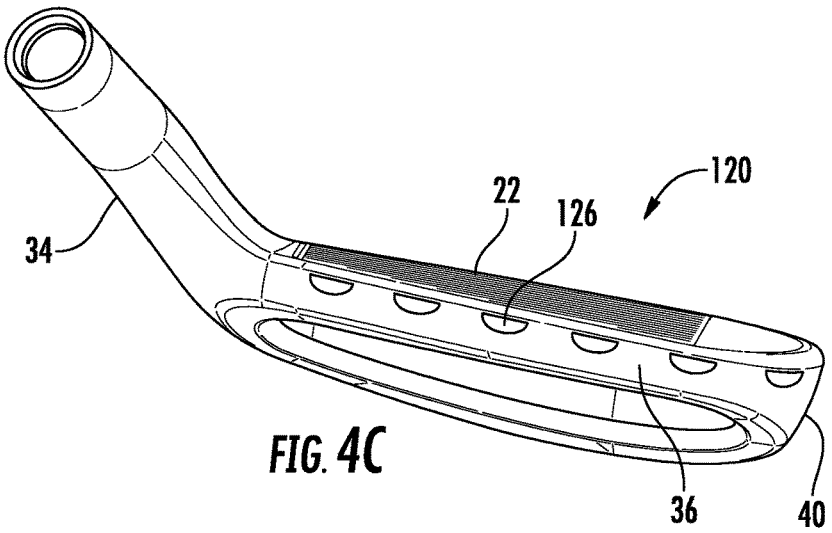
Figure 4D:
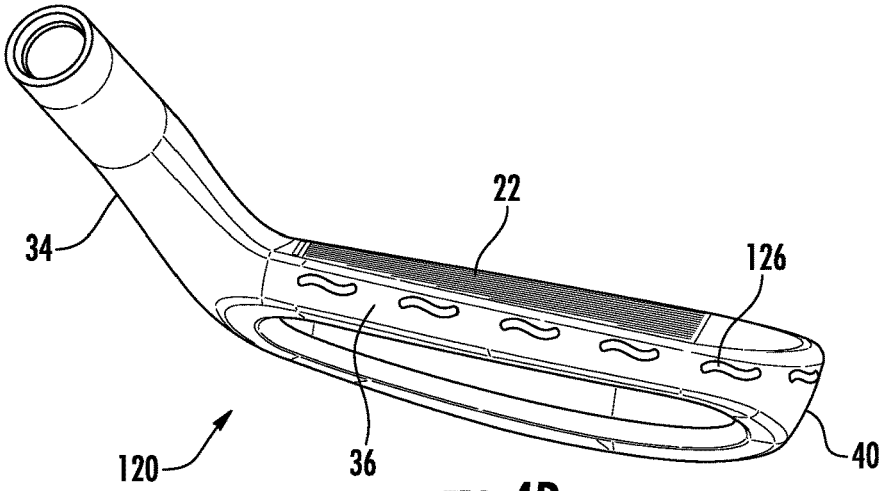

In other implementations, aperture 126 may have other shapes, other sizes and other numbers. FIGS. 4A through 4D illustrate example implementations of different shapes, numbers and sizes of apertures 126 that can be formed in the body 124. FIG. 4A illustrates a plurality of triangular shaped apertures 126 formed into the wall 36 of the body 124. FIGS. 4B and 4C illustrates a plurality of circular shaped and semi-circular shaped apertures 126, respectively. FIG. 4D illustrates a plurality of wavy or curved apertures 126. In other implementations, apertures 126 can be formed in other polygonal shapes, other curved shapes, other irregular shapes, and combinations thereof. Additionally, the number and size of the apertures can vary from 2 to 20. In one implementation, the number of apertures can be within the range of 3 to 15. In some implementations, aperture 26 may have different shapes in different lengths depending upon the location of the aperture 26. For example, a first size or shape aperture 26 may be provided on topline 42 or other shapes or numbers of apertures 26 are provided on sole 38 or toe 40. In some implementations, aperture 26 may be in the form of a cutout through (partially or entirely) a portion of wall 36, wherein the cutout has an outline of a word or words, letter, logo or image. For example, in one implementation, aperture 26 may spell out a symbol, a trademark, a name of the manufacturer, a brand of the golf club head 20 or the like. All such variations are contemplated under the present invention.

Figure 5:
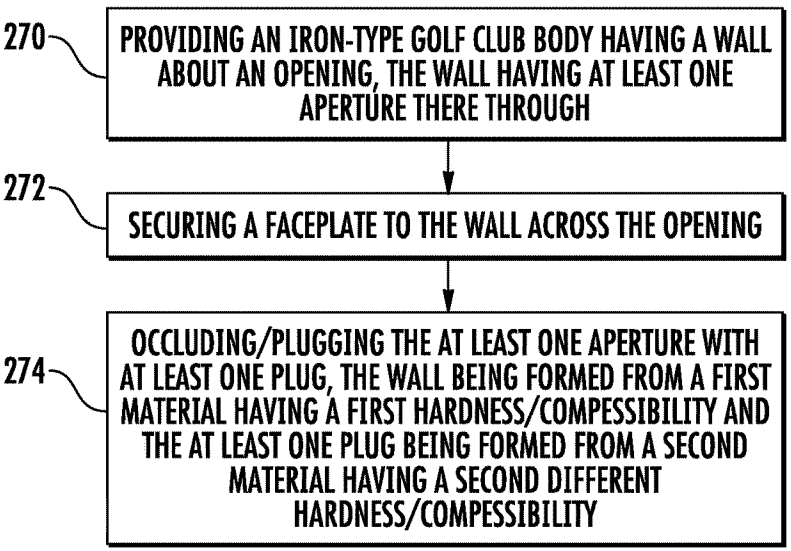
FIG. 5 is a flow diagram of an example method for forming an iron-type golf club head.

FIG. 5 is a flow diagram of an example method of forming an iron-type golf club head, such as head 20 or head 120. As indicated by block to 270, an iron-type golf club body is provided, wherein the body has a wall, such as wall 36, about an opening, such as opening 32. The wall has at least one aperture, such as aperture 26 or aperture 126, therethrough. As indicated by block 272, a faceplate, such as faceplate 22, is secured to the wall across the opening. In one implementation, the faceplate is welded to the wall.

As indicated by block 274, the at least one aperture is occluded or plugged with at least one plug, such as plug 26, plug 126 or any of the plugs described hereafter. While the wall is formed from a first material having a first hardness and/or compressibility, the at least one plug is formed from a second material having a second different hardness and/or compressibility. For purposes of this disclosure, the term "material" encompasses a single material, multiple layers of a material or a mixture of multiple materials. As will be described hereafter, in some implementations, the at least one plug may be formed by injecting a plug material, while in a liquid or viscous state into such apertures. In other implementations, the at least one plug may be formed by inserting into the golf club body a preformed panel or insert providing one or more plugs.

FIGS. 6A-6D illustrate one example method for forming any of golf club heads 20, 120 or 220. FIGS. 6A-6D illustrate an example method in which an example iron-type golf club head 320 is plugged. As shown FIG. 6A, the unplugged head 320 is similar to head 120 described above. Those components of head 320 which correspond to components of head 120 are numbered similarly.

Figure 6C:
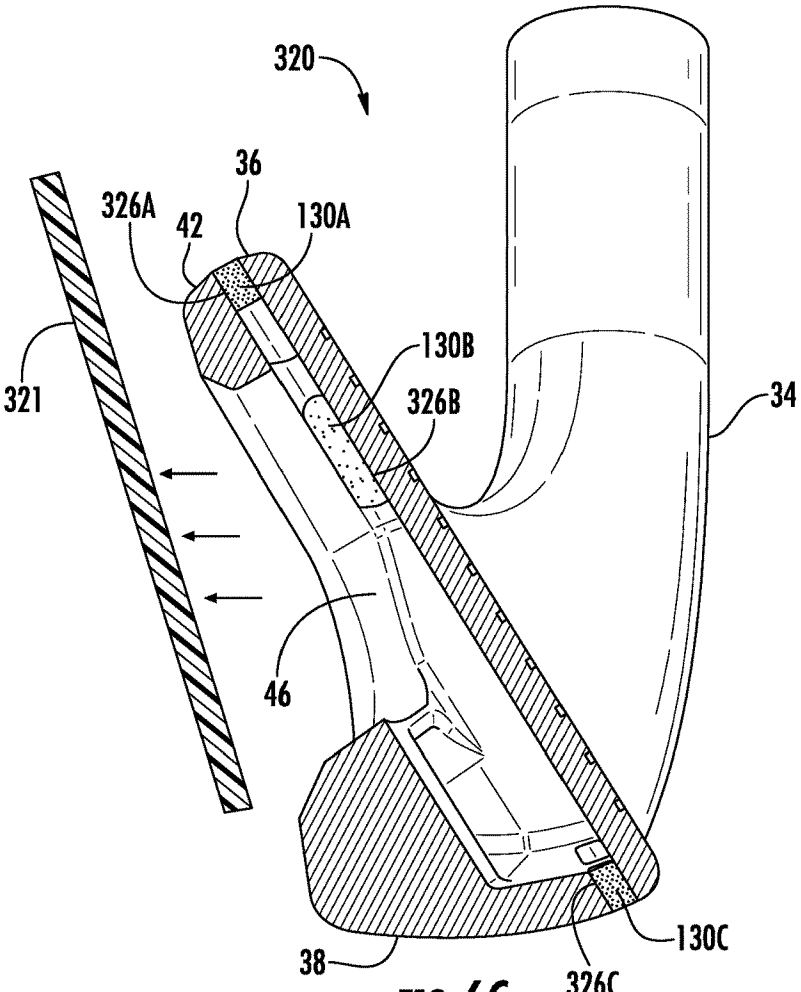
Figure 6B:
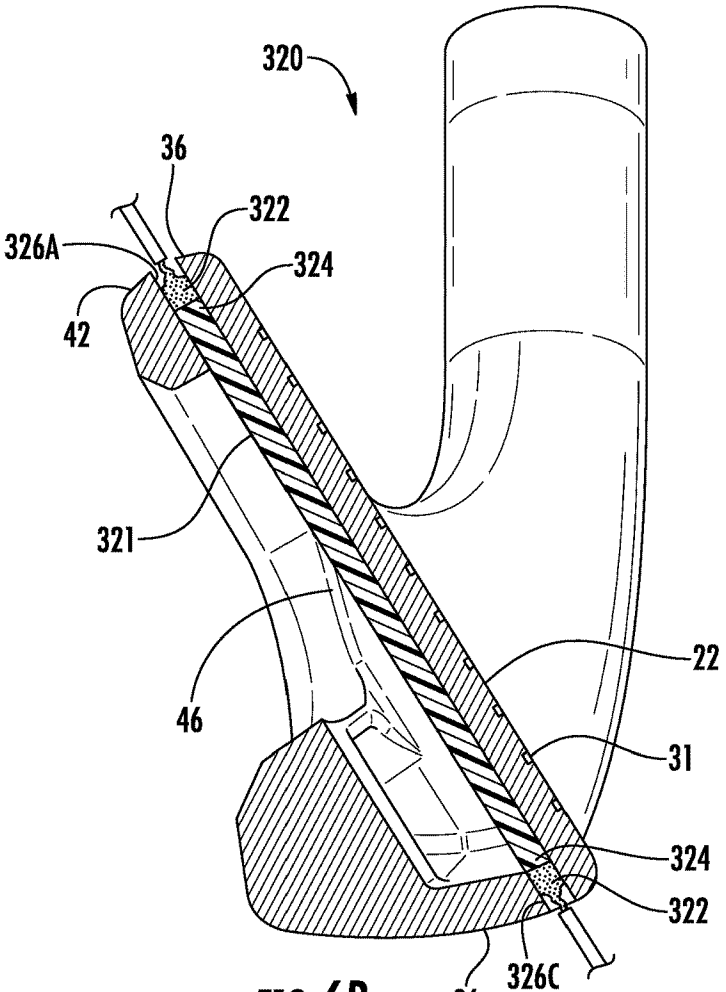

As shown by FIG. 6B, a stopper 321 is inserted into the cavity 46 behind faceplate 22 such an edges of stopper 321 extend across apertures 326. As further indicated by FIG. 6B, plug material 322, in liquid form, is injected or otherwise deposited into apertures 326. In one implementation, plug material 322 comprises a polymer that, upon curing or solidifying, has a hardness less than that of the material of wall 36 and a compressibility or flexibility greater than that of wall 36. In one implementation, plug material 322 comprises a urethane. In one implementation, plug material 322 comprises an open cell or closed celled foam material. In yet other implementations, plug material 322 comprises other materials which may place in a liquid or viscous state and subsequently dried or cured to a solid or semi-solid state.

As shown by FIG. 6B, the edges 324 of stop 321 limit the extent to which plug material 322 may flow into or through apertures 326. As further shown by FIG. 6B, some implementations, stop 321 is sized so as to not necessarily terminate at the edge of one of aperture 326, but is sized to be inserted into or project into selected apertures 326. In such an implementation, the configuration of stop 321 may be varied to control the extent to which individual apertures 326 are filled with plug material 322. In the example illustrated, stop 321 partially projects into aperture 326A, limiting the extent to which aperture 326A is filled with plug material 322. At the same time, stop 321 terminates prior to extending into aperture 326C, facilitating a complete fill of aperture 326C.

As shown by FIG. 6C, upon sufficient curing or solidification of the plug material within apertures 326, stop 321 is removed from cavity 46. In one implementation, stop 321 is resiliently flexible facilitating deformation to allow stop 321 to be removed from cavity 46. In another implementation, stop 321 is formed from a destructible material, wherein stop 321 is sacrificed after the plugging of club 320. In yet another implementation, stop 321 may be omitted such as where the injection of plug material 322 is precisely controlled or where walls 36 include integral structures that at least partially extend behind and across such apertures 322 so as to serve as stops to limit the flow of plugging material into or through apertures 326. In some implementations, other inserts are structures may be inserted into cavity 426 behind our partially into aperture 3262 control the extent to which plug material 322 fills or occupies such apertures, wherein such inserts are left in place following the injection of plug material 322. In one implementation, such inserts may comprise an open web, open frame or other structure having boards or cavities into and through which plug material 322 is filled or injected to occupy the voids of the insert, wherein the insert act as rebar modifying the characteristics of the plug material 322 within the respective aperture 326. The plug material 322 solidifies, cures or hardens to form plugs 130 described above.

Figure 6D:
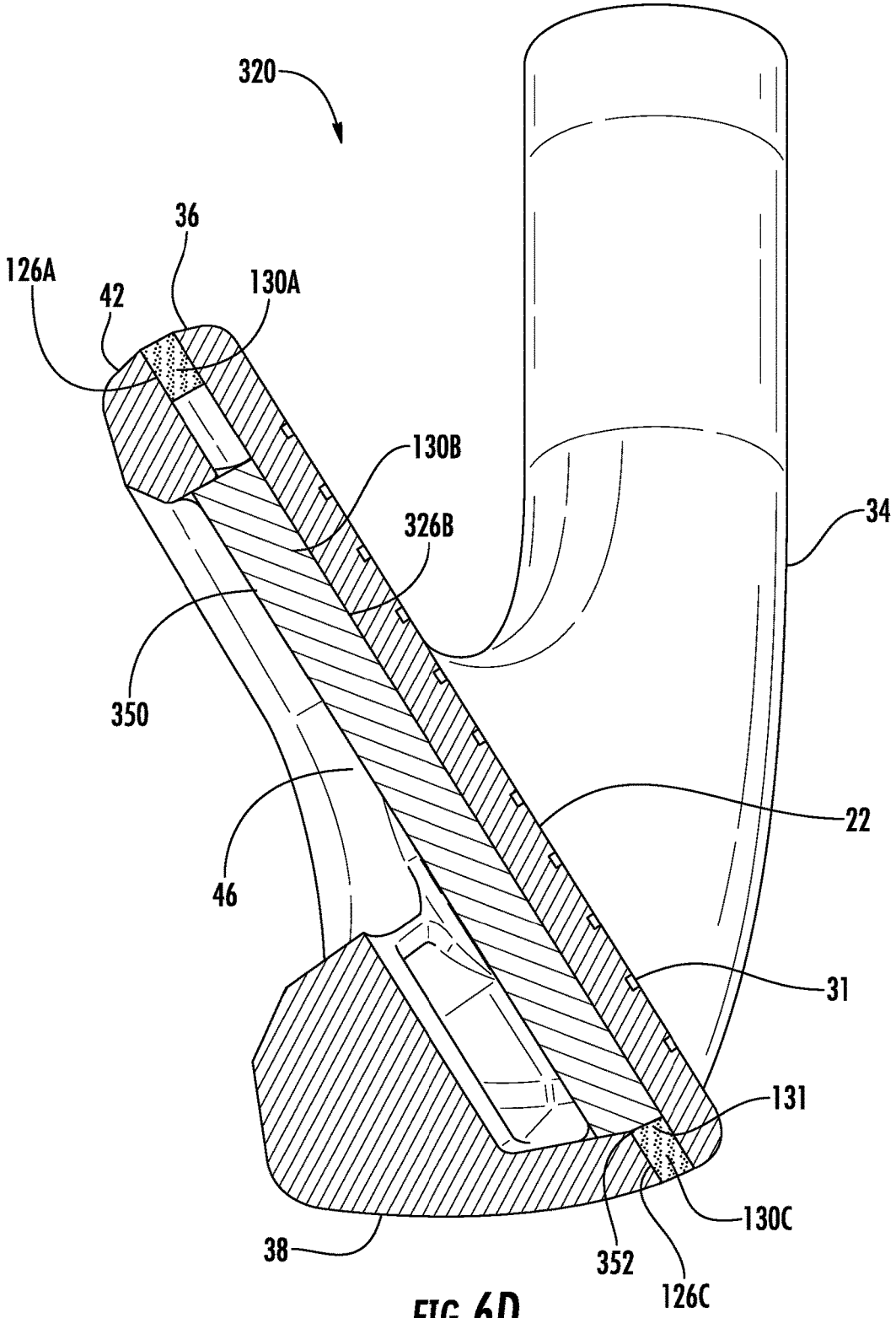

As shown by FIG. 6D, in the example illustrated, a badge 350 is inserted into cavity 46. In one implementation, badge 350 comprises a placard, panel or other structure containing logos, labels or the like. In one implementation, badge 350 is covered or coated with a metallic film. The badge 350 can be formed as a single piece or part or of multiple pieces or parts. The badge 350 may have a uniform thickness or variable thickness. The badge 350 may be thinner than illustrated in FIG. 6D. The badge 350 can be sized to fill or partially fill the cavity 46. The badge 350 may be sized to completely cover the back surface of face plate 22. In other implementations, the badge 350 may be sized to cover a portion, such as at least 25 percent, of the surface area formed by the exposed back surface of the face plate 22 attached to the wall 36. In the example illustrated, badge 350 has outer perimeter edges 352 that abut the inner surfaces 131 of plugs 130 to stabilize the positioning of such plugs 130 and to inhibit inadvertent dislodge with an inward movement of plugs 130. In yet other implementations, badge 350 may be omitted.

Figure 7B:
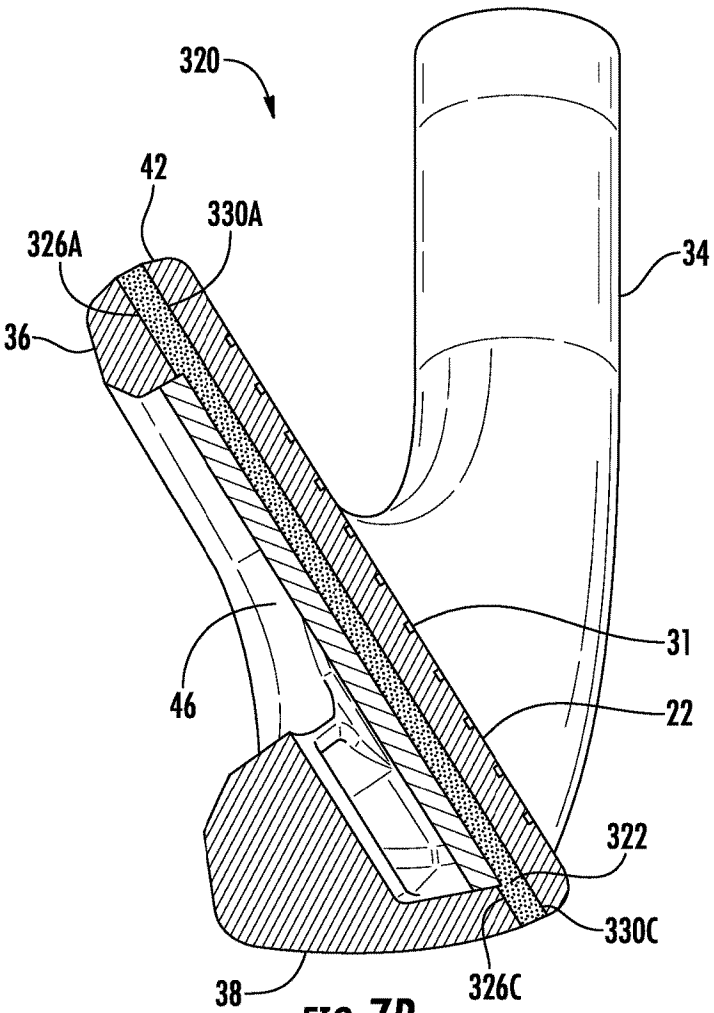
FIGS. 7A-7B are sectional views of an example iron-type golf club head, illustrating another example method for plugging the golf club head.
Figure 7A:
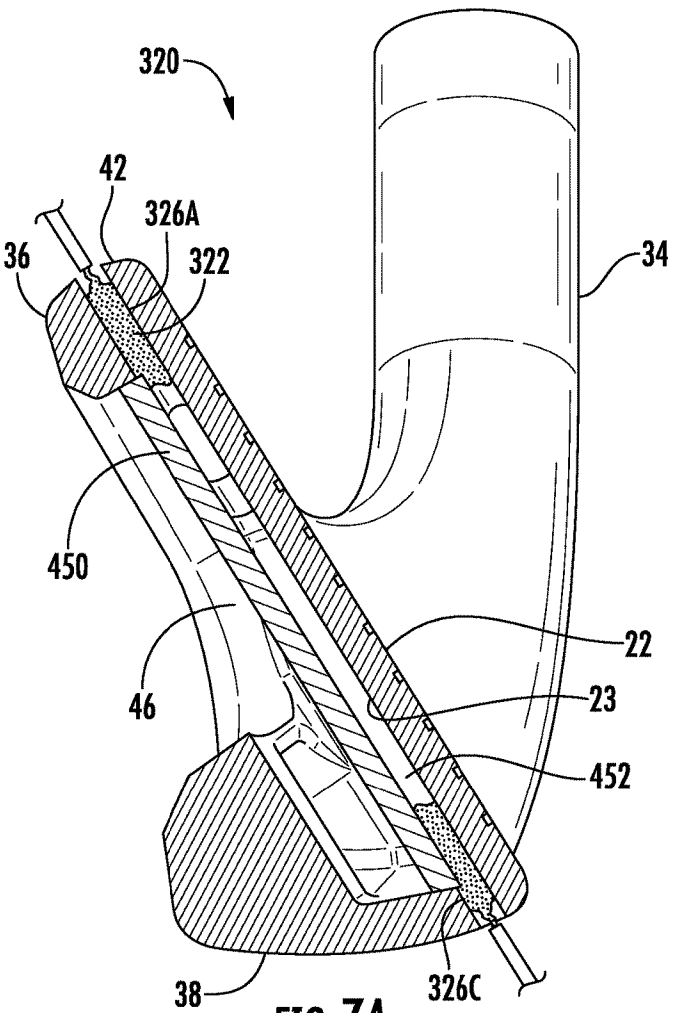

FIGS. 7A and 7B illustrate yet another method for plugging golf club head 320. As shown by FIG. 7A, and insert 450 is positioned within cavity 46. In one implementation, walls 36 include internal shoulders or catches which control positioning of such that insert 450 is spaced from the inner rear surface 23 of faceplate 22 so as to form an internal void 452. Thereafter, plug material 322 is injected into apertures 326 and into void 452, between insert 450 and faceplate 22, wherein material 322 within such apertures 326 form plugs 330A and 330C and additional plugs for additional apertures 326 not illustrated. As shown by FIG. 7B, in one implementation, void 452 is completely filled with plug material 322 such that plug material 322 continuously extends from one aperture 326 through void 452 to another of apertures 326. In one implementation, insert 450 is left in place within cavity 46. In one implementation, insert 450 comprises a badge having a rear surface having markings, and indicia, logos, labels or the like. In yet another implementation, upon sufficient solidification or curing of plug material 322 to form the various plugs 130 as well as the expanse of material connecting such plugs 130, insert 450 may be removed. In one implementation, sensor 450 is removed and replaced with a decorative badge, such as badge 350. In some implementations, the method or process shown in FIGS. 7A and 7B may be carried out without insert 450. For example, in some implementations, head 320 may be supported in a fixture during plugging such that rear surface or face 23 of faceplate 22 extends substantially horizontal, wherein the viscous or liquid plug material 322 flows across the horizontal surface 23 under the guidance of gravity and is permitted to cure or otherwise modify.

Figure 8:
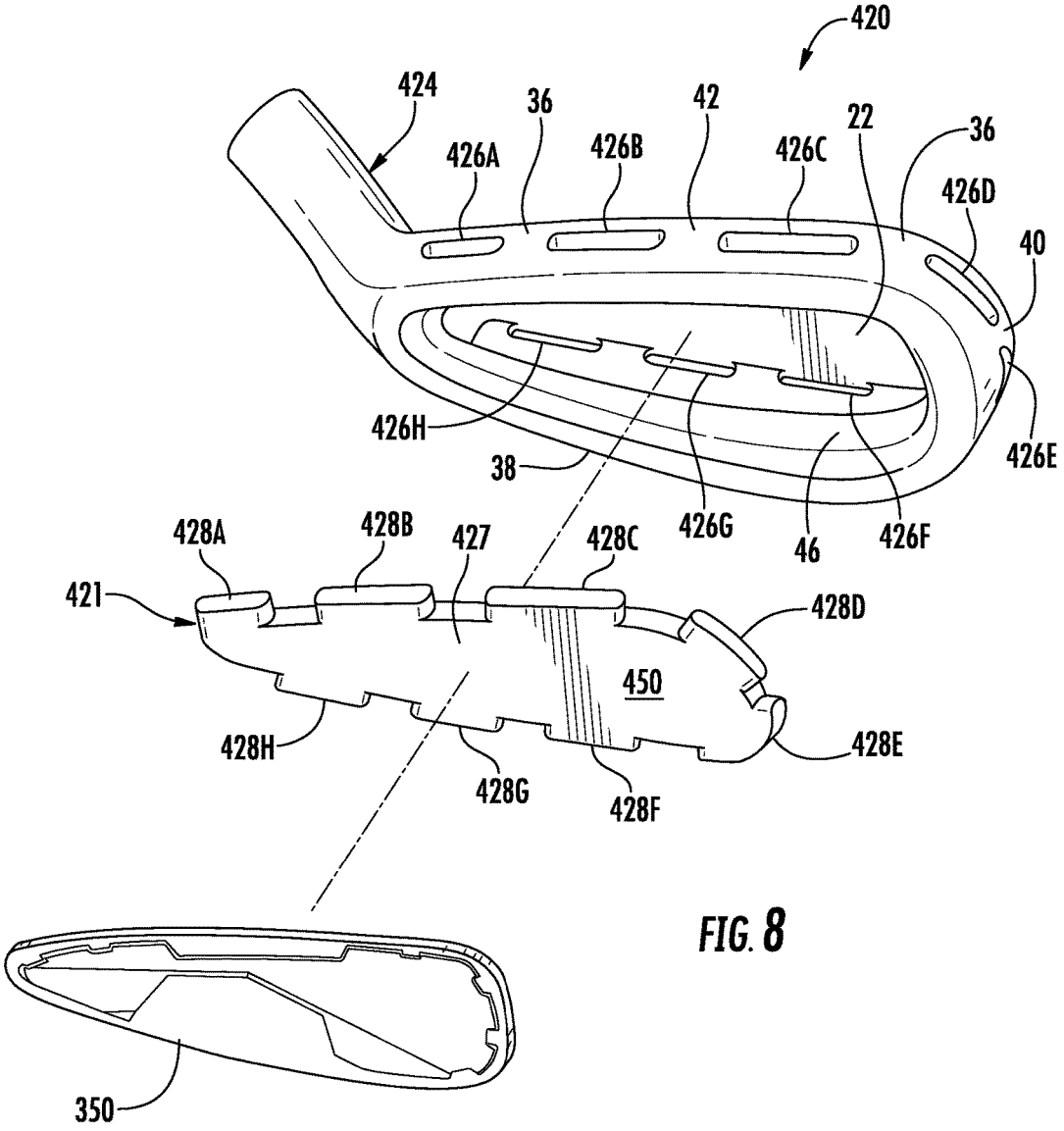
FIG. 8 is an exploded rear perspective view of another example iron-type golf club head.

FIG. 8 is an exploded view illustrating iron-type golf club head 420, another implementation of golf club head 120. Golf club head 420 comprises body 424, insert 421 and badge 350. Body 424 is similar to body 124 described above except that body 424 comprises eight apertures 426 rather than nine apertures 126. Remaining aspects of body 424 are described above with respect to body 1 to 4 of club head 120. Badge 350 is described above with respect to club head 320. Head 420 is similar to head 120 described above except that head 420 utilizes insert 421 to provide plugs for apertures 126.

As shown by FIG. 8, insert 426 comprises a panel or other structure sized, shaped in form from is sufficiently flexible or bendable material so as to enable insert 421 to be inserted into cavity 46 of body 24, within the loop formed by wall 36 and behind faceplate 22. Insert 421 comprises a central body 427 and one or more projections, fingers, extensions or tabs 428A, 428B, 428C, 428D, 428E, 428F, 428G and 428H (collectively referred to as tabs 428) extending from body 427. Each of tabs 428A, 428B, 428C, 428D, 428E, 428F, 428G and 428H is located and sized to be concurrently inserted into apertures 426A, 426B, 426C, 426D, 426E, 426F, 426G and 426H, respectively, where tabs 428 serve as plugs for each of such corresponding apertures 426. In one implementation, insert 421 is resilient and bendable, allowing insert 421 to be bent such that 428 may be snapped into corresponding apertures 126, wherein 428 are held within apertures 126. Each of tabs 428 has a hardness less than a hardness of the surrounding material of wall 36. Each of tabs 428 has a compressibility or flexibility greater than that of the material forming wall 36.

In one implementation, insert 421 is furthered adhesively bonded or fused to body 24 once positioned within cavity 46. In another implementation, insert 421 is removable from cavity 426 and from apertures 426, allowing the insert 421 of head 422 be replaced or exchanged. In some implementations, head 420 may be accompanied by a set of multiple different inserts 421, each insert 421 having tabs 428 with different degrees of hardness and/or different degrees of flexibility or compressibility. As a result, in such a system, a golfer may customize his or her club 420 through the selection and use of different inserts 421. Once insert 421 has been position within cavity 46 with tabs 428 positioned within their corresponding apertures 426, badge 350 is positioned behind insert 421. In other implementations, badge 350 may be omitted. In some implementations, the markings, logos or decorative effects otherwise provided by badge 350 or alternatively provided on the rear face 450 of insert 421.

Although insert 421 is illustrated as having eight tabs 428 corresponding to the eight apertures 426 of body 424, in other implementations, insert 421 may comprise fewer than or greater than eight such tabs, wherein some or all of the apertures 426 are filled by a tab 428. For example, in some implementations, some of the apertures 426 not filled by tabs 428 of insert 421 are injected with a plug material, such as plug material 322 described above. In one implementation, the perimeter edges of insert 421 that do not project into an opposite aperture 426 in wall 36 may serve as a stop controlling and extent to which the plug material 322, injected in liquid form prior to solidification, fills the particular apertures 426 not plugged by insert 421. In other implementations where wall 36 of the particular golf club comprises a greater or fewer of such apertures 126 or where apertures 426 additionally sized or differently located, insert 421 may also include a different arrangement of tabs 428 based upon the different number, size, location and/or shape of the different apertures 426.

Figure 9:
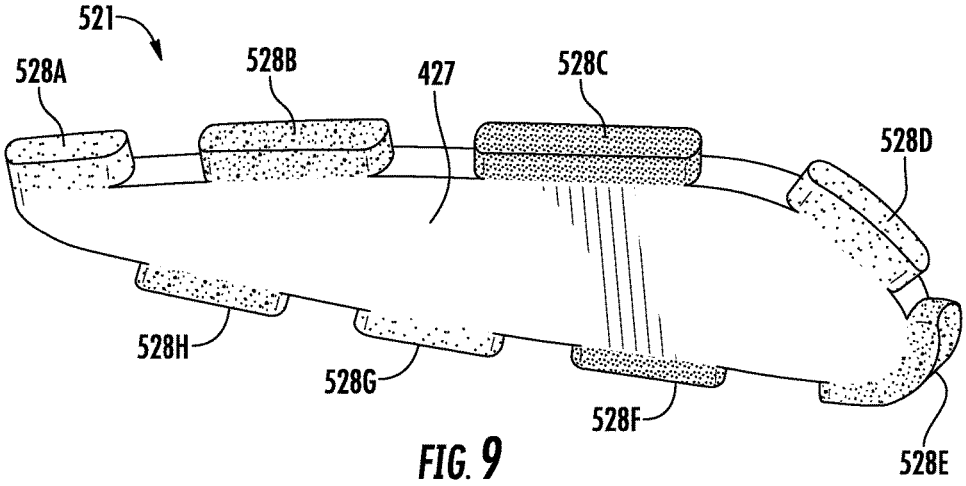
FIG. 9 is a perspective view of an example insert for use with a body of the iron-type golf club head of FIG. 7.

FIG. 9 illustrates insert 521, another example of insert 421 for use with head 420. Insert 521 is similar to insert 421 except that insert 521 comprises tabs 528A, 528B, 528C, 528D, 528E, 528F and 528G (collectively referred to as tabs 528) in lieu of tabs 428. Tabs 528 include individual tabs formed from different materials or compositions so as to have different hardness properties and/or different compressibility, flexibility properties. In the example illustrated, tabs 528C the 528F are formed from a different material or a different combination of materials such that they have different hardness properties and/or different compressibility or flexibility properties as compared to the remaining tabs 528. As a result, in one implementation, tabs 528C and 528E may comprise a first type of urethane material while remaining tabs are formed from a different type of urethane material are completely different material. In one implementation, tabs 528C and 528E are formed from a solid polymer while the remaining tabs are formed from an open or closed cell polymer. In one implementation, some of 528 may be solid other of tabs 528 may be hollow. With respect to those hollow tabs, different tabs 528 may have different wall thicknesses and differently sized or shaped hollow interiors. The different material properties of tabs 528 allow the absorption or impact characteristics of head 222 be selectively varied with respect to different adjacent portions of faceplate 22. In some implementations, different inserts 521 may be provided with different combinations of tabs or patterns to customize the performance of the golf club head in which such inserts 521 are used to an individual golfer's skill level or personal preferences.

Figure 10:
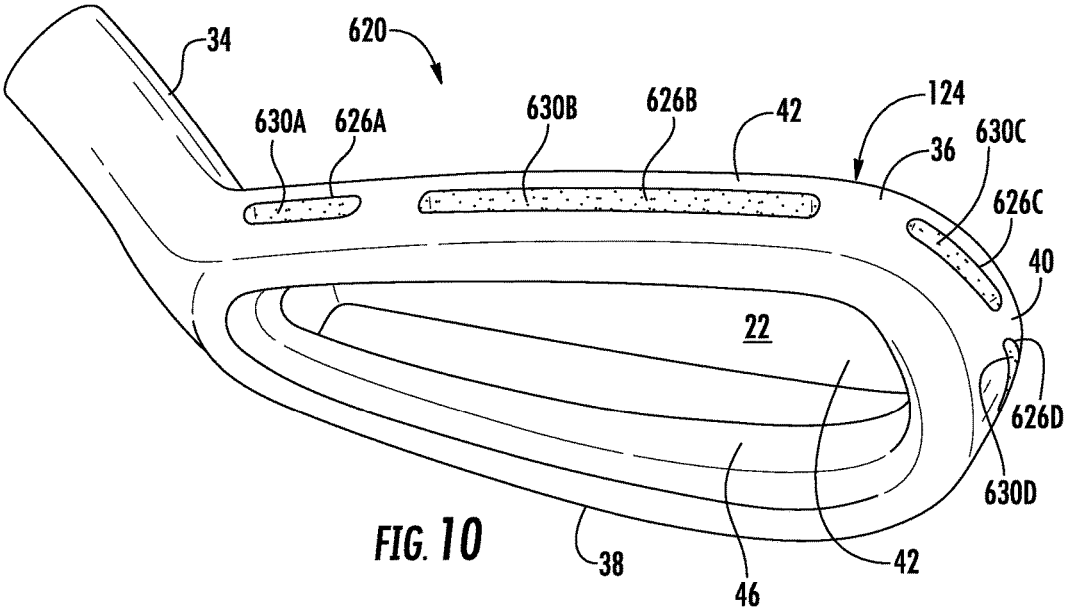
FIG. 10 is a rear perspective view of another example iron-type golf club head having another arrangement of apertures and plugs.

FIG. 10 illustrates iron-type golf club head 620. Head 620 is similar to heads 20, 120 and 420 except that head 620 comprises a different arrangement of apertures and corresponding plugs. In the example shown in FIG. 8, head 620 includes differently sized apertures 626 and corresponding differently sized plugs 630. As may be appreciated from FIG. 8, different iron-type golf club heads may be relied with apertures of different sizes, shapes and locations and different plugs of corresponding different sizes, shapes and locations. For example, a first 7-iron may be provided with a first layout of apertures and plugs while a second 7-iron may be provided with a second layout of apertures and plugs depending upon the material forming the rest of the body of the club, the thickness and dimensions of wall 36 of the club as well as the skill level or preference of the golfer who is to use the club. Likewise, different types of irons may divide with different layouts of apertures and plugs. For example, a 4-iron may be provided with a first layout of apertures and plugs that is different from the layout of apertures and plugs of a 7-iron. A 7-iron itself may be provided with a layout of apertures and plugs that differs from the layout of apertures and plugs of the 9-iron or a wedge.

FIGS. 11 through 16 illustrate another example implementation of the present invention. A golf club head 720 is similar to heads 20, 120, 220, 320, 420 and 620 except the head 720 includes a body 724 that defines a first set of apertures 726 and at least one second aperture 728. The prior disclosure is applicable to the golf club head 720 and other implementations as referenced below. The body 724 supports, and is coupled to, the faceplate 22. The body 724 includes a hosel 734 comprising a hollow cylinder for receiving a tip end of a golf shaft. The body 724 further includes a wall 736 extending in a loop starting and ending at the hosel 734. The body 724 and the wall 736 are substantially similar to the body 24 and the wall 36. The wall 736 has a first hardness value that is substantially the same as the wall 36. The wall 736 includes an outer peripheral surface 737, a sole 738, a toe 740 and a topline 742. The sole 738 comprises the underside of the wall 736 that faces the ground when a golf ball is addressed by the head 720 during use. The toe 740 comprises the end portion of the head 720, and the topline 742 comprises the top portion of the wall 736 opposite the sole 738.

Figure 13:
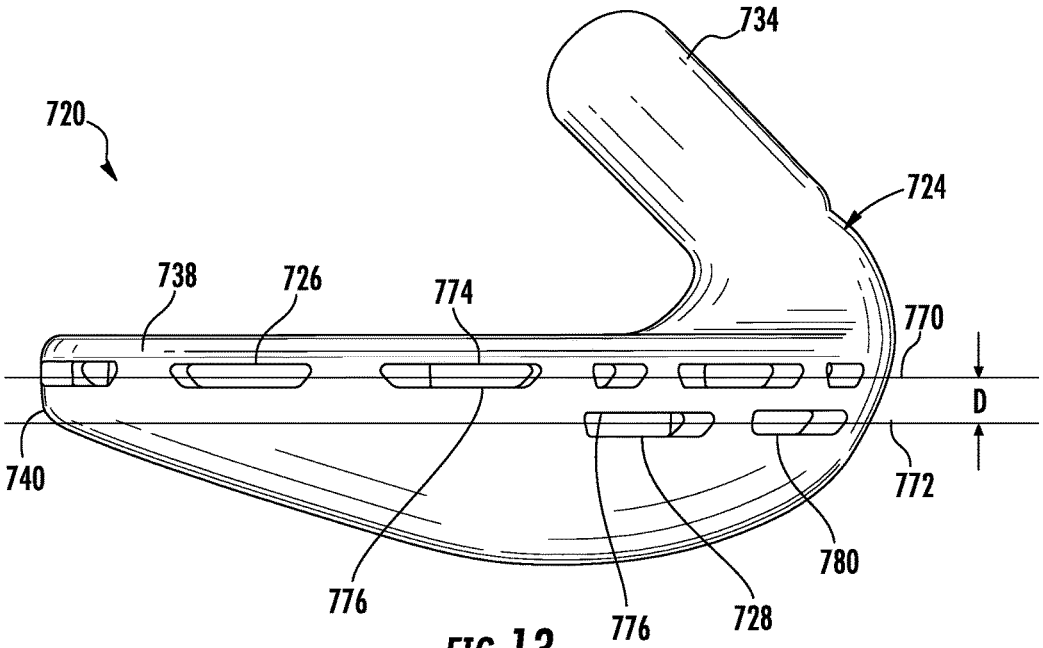
FIG. 13 is a toe end, bottom perspective view of the golf club head of FIG. 12.
Figure 14:
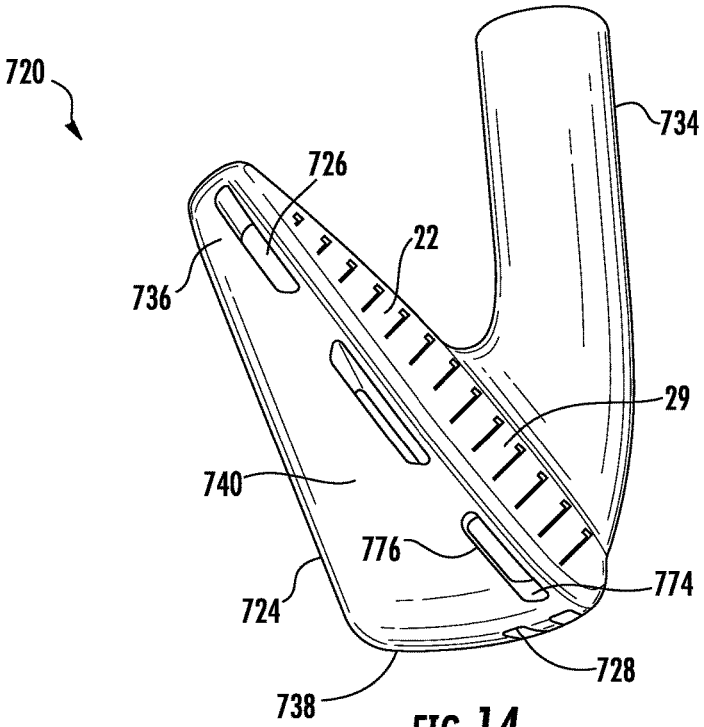
FIG. 14 is a toe end view of the golf club head of FIG. 12.
Figure 15:
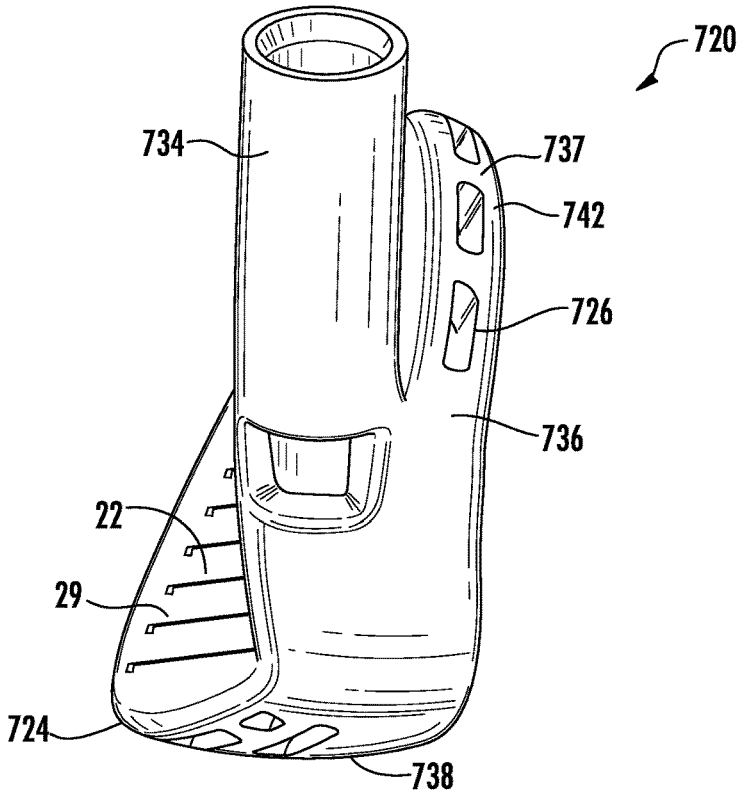
FIG. 15 is a heel end view of the golf club head of FIG. 12.
Figure 16:
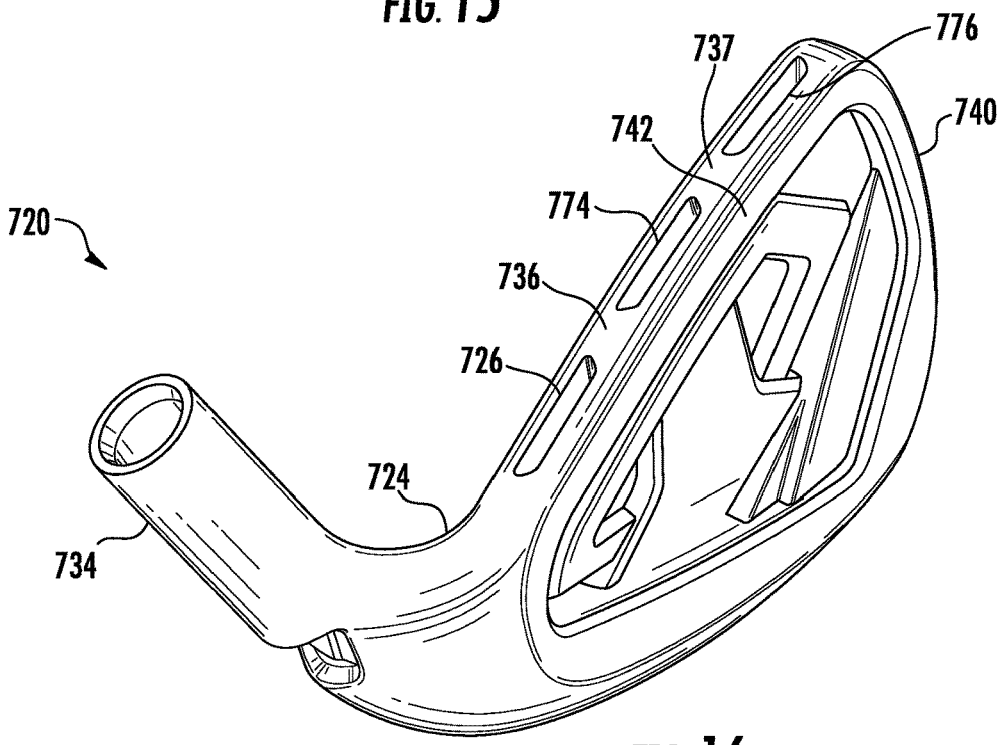
FIG. 16 is a top, rear perspective view of the golf club head of FIG. 12.

The wall 736 defines the first set of apertures 726 and at least one second aperture 728. As best shown in FIG. 13, the first set of apertures 726 extend about a first plane 770 and the at least one second aperture 728 extends about a second plane 772. In other words, the first plane 770 extends through each of the first set of apertures 770, and the second plane 772 extends through the at least one second aperture 728. The first and second planes 770 and 772 can be parallel to each other. The first and second planes 770 and 772 can be spaced apart from each other by a distance, D. In one implementation, the distance D can be within the range of 0.010 to 0.50 inch. In other implementations, the distance D can be outside of the range 0.010 to 0.50 inch. In other implementations, the first and second planes may be angled with respect to each other. In other implementations, one or both of the first and second planes 770 and 772 can be parallel to the generally planar impact surface 29. In other implementations, the first and/or second planes 770 and 772 may be angled with respect to the generally planar impact surface 29 within the range of 1 to 10 degrees.

The first set of apertures 726 are substantially similar to apertures 126. In FIGS. 11 through 16, the first set of apertures 726 include a total of nine (9) slots arranged end to end about the first plane 770. Three apertures of the first of apertures 726 are defined into the topline 742, three apertures of the first of apertures 726 are formed into the toe end 740, and three of the first of apertures 726 are formed into the sole 738 of the wall 726. In other implementations, the first set of apertures 726 can number 2, 3, 4, 5, 6, 7, 8, 10, 11 or more apertures, and can be spaced apart along the topline, the toe and/or the sole in any manner including one or more of topline, the toe and the sole can be formed without any of the first set of apertures 726. The first set of apertures 726 can be formed in the shape of slots, and can be formed of different or varying slot lengths. The slots 726 can have a length of at least 0.125 inch and a width W within the range of 0.025 and 0.25 inch. In other implementations, the first set of apertures 726 can be formed as slots of the same length. In other implementations, the first set of apertures 726 can be formed with any combination of shapes, lengths, widths and numbers. The faceplate 22 defines the planar impact surface 29 and the first set of apertures 726 can include forward and rearward edges 774 and 776. The forward edge 774 of the first set of apertures 726 can be spaced apart from the planar impact surface 29 by a distance of at least 0.030 inch. In one implementation, the forward edge 774 is spaced apart from the planar impact surface 29 by a distance d within the range of 0.030 to 0.15 inch. In other implementations, the forward edge 774 can be spaced part from the impact surface 29 by other dimensions outside of 0.030 to 0.15 inch.

Figure 11:
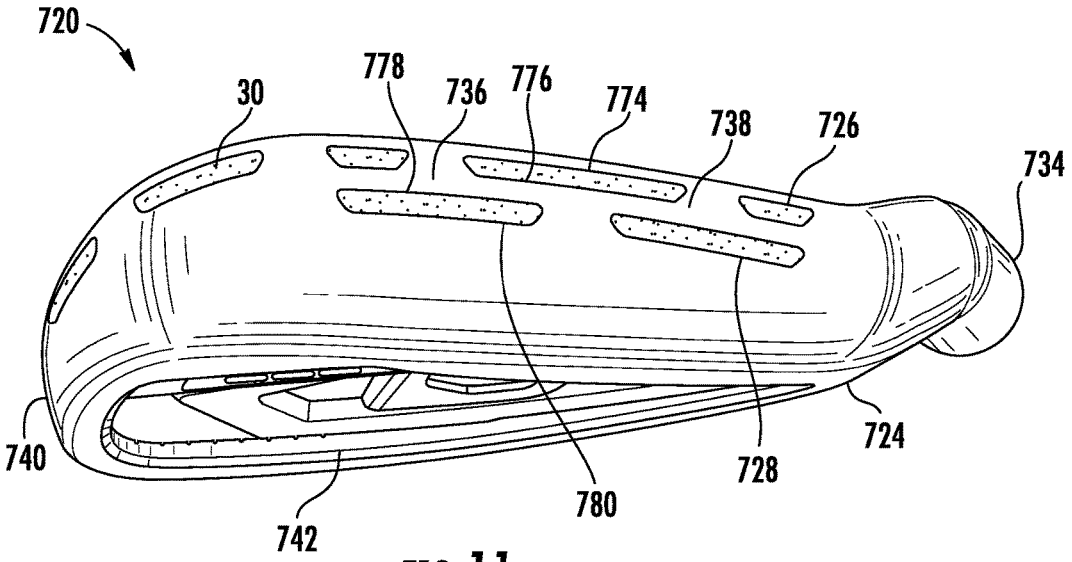
FIG. 11 is a bottom, rear perspective view of the golf club head in accordance with another example implementation of the present invention in which the club head includes a body defining first and second sets of apertures and a plurality of plugs are positioned within the first and second sets of apertures.
Figure 12:
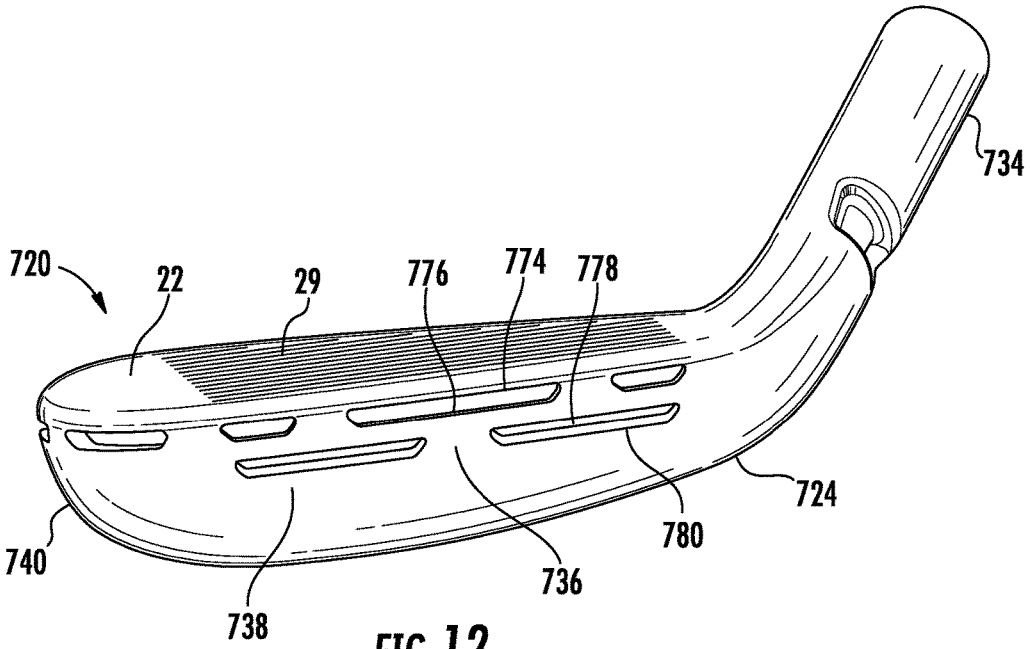
FIG. 12 is a bottom front perspective view of the golf club head of FIG. 11 without the plugs within the first and second sets of apertures.

The at least one second aperture 728 is rearwardly spaced apart from the first set of apertures 726 on the body 724. In another implementation, the at least one second aperture 728 is at least two second apertures 728 forming a second set of apertures 728. As shown in FIGS. 11-13, the at least two second apertures 728 can be positioned on the sole 738 of the body 724. In other implementations, the at least two apertures forming the second set of apertures 728 can number 3, 4, 5, 6, 7, 8, 9, 10 or more second apertures. In other implementations, the at least one second aperture 728 can be positioned on one or more of the sole 738, the toe end 740 and/or the topline 742. The second set of apertures 728 can be sized, shaped and/or numbered in a manner similar to the first set of apertures 726. The first and second sets of apertures 726 and 728 can have the same length, or they can variable lengths. The apertures 726 and 728 can be spaced about faceplate 22, through each of the sole 738, the toe 740 and the topline 742 of the wall 736. Any combination of numbers, shapes, sizes for the first and/or second sets of apertures 726 and 728 can be used and are contemplated by the present invention. In one implementation, the second set of apertures 728 can have lengths of at least 0.125, and widths within the range of 0.025 to 0.25 inch. The second set of apertures 728 can be shaped as slots or other shapes. The second set of apertures 728 can have a second forward edge 778 and a second rearward edge 780. In one implementation, the first rearward edge 776 of the first set of apertures 726 can be spaced apart from the second forward edge 778 by a distance within the range of 0.030 to 0.50 inch. In one implementation, the first and second sets of apertures 726 and 728 can be extend entirely through the thickness of the wall 736.

Referring to FIG. 11, the first and second sets of apertures 726 and 728 can be filled, or generally filled, by the plug 30. The plug 30 as described above with respect to apertures 26 and 126, can also be used in association with the first and second sets of apertures 726 and 728. The plugs 30 can be viewable from the outer peripheral surface 737 of the wall 736. The plug 30 or plugs 30 have or have a hardness value that is less than the hardness value of the wall 736. The golf club head of FIG. 11 can provide a unique, aesthetically-pleasing appearance and sound upon impacting a golf ball.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements.

What is claimed is:

1. An iron-type golf club head comprising:

a body having a wall extending about an opening, the wall having an outer peripheral surface, a sole, a toe and a topline;

a faceplate coupled to the body across the opening, the wall and the faceplate defining a rearward-facing cavity;

a first set of apertures extending through the wall from the peripheral outer surface to the cavity, the first set of apertures extending about a first plane, the first set of apertures including at least two first apertures positioned on the sole and spaced apart in an end to end manner; and at least one second aperture extending through the wall from the peripheral outer surface to the cavity, the at least one second aperture extending about a second plane, each of the first and second planes being rearwardly spaced from the faceplate, wherein one of the at least one second aperture is positioned on the sole rearward of the at least two first apertures.

2. The golf club head of claim 1, further comprising a plurality of plugs positioned within a separate one of the first set of apertures and the at least one second aperture.

3. The golf club head of claim 2, wherein the wall has a first hardness value, wherein the plurality of plugs have a second hardness value, and wherein the second hardness value is less than the first hardness value.

4. The golf club head of claim 1, wherein the first and second planes are parallel planes.

5. The golf club head of claim 1, wherein each of the plugs fill at least 80% of the respective aperture in which it is positioned.

6. The golf head club of claim 1, wherein the hardness values of the plurality of plugs vary.

7. The golf club head of claim 1, wherein the hardness values of the plurality of plugs are of equal hardness.

8. The golf head club of claim 1, wherein the first set of apertures includes at least four apertures, wherein the at least four apertures of the first set of apertures extend end to end along the topline adjacent the faceplate, extend end to end along the sole adjacent the faceplate, and extend end to end along the toe adjacent the faceplate.

9. The golf club head of claim 1, wherein the first set of apertures includes at least four apertures, and wherein the at least one second aperture includes at least two apertures forming a second set of apertures.

10. The golf club head of claim 9, wherein the first set of apertures includes at least five apertures.

11. The golf club head of claim 9, wherein the first set of apertures includes at least six apertures.

12. The golf club head of claim 1, wherein the plurality of plugs are formed of an open or closed cell material.

13. The golf club head of claim 1, wherein the face plate includes a planar impact surface, wherein at least one of the first set of apertures includes a first forward edge and a first rearward edge, wherein at least one second aperture includes a second forward edge and a second rearward edge.

14. The golf club head of claim 13, wherein the first forward edge is spaced apart from the planar impact surface by a distance within the range of 0.030 to 0.150 inch.

15. The golf club head of claim 13, wherein the first rearward edge is spaced apart from the second forward edge by a distance within the range of 0.030 to 0.50 inch.

16. The golf club head of claim 1, wherein at least one of the first set of apertures forms a first slot, wherein at least one second aperture forms a second slot, and wherein the first and second slots each have a length of at least 0.125 inch and a width within the range of 0.025 to 0.25 inch.

17. The golf club head of claim 1, wherein the first plane is parallel to a face plane defined by a planar impact surface of the faceplate.

18. The golf club head of claim 1, wherein the plurality of plugs are viewable from the outer peripheral surface of the wall.

19. The golf club head of claim 1, wherein the first set of apertures have variable lengths.

20. The golf club head of claim 9, wherein the second set of apertures have variable lengths.

21. The golf club head of claim 1, wherein the first set of apertures have substantially the same length.

22. The golf club head of claim 9, wherein the second set of apertures have substantially the same length.

23. The golf club head of claim 4, wherein the at least two first apertures are spaced apart by one or more portions of the wall of the body, and wherein the at least one second aperture overlies one of the portions of the wall spacing apart the at least two first apertures, when viewing the sole of the club head from a rearmost surface of the body toward the face plate of the golf club.

* * * * *